US007234992B2

(12) United States Patent
Weiss et al.

(10) Patent No.: US 7,234,992 B2
(45) Date of Patent: Jun. 26, 2007

(54) REMOTELY CONTROLLED TOY VEHICLES WITH LIGHT(S)

(75) Inventors: Stephen N. Weiss, Philadelphia, PA (US); Eric D. Listenberger, Moorestown, NJ (US); Joseph T. Moll, Prospect Park, PA (US)

(73) Assignee: Mattel, Inc., El Segundo, CA (US)

( * ) Notice: Subject to any disclaimer, the term of this patent is extended or adjusted under 35 U.S.C. 154(b) by 149 days.

(21) Appl. No.: 10/699,453

(22) Filed: Oct. 30, 2003

(65) Prior Publication Data

US 2004/0092208 A1 May 13, 2004

Related U.S. Application Data

(60) Provisional application No. 60/423,182, filed on Nov. 1, 2002.

(51) Int. Cl.
*A63H 30/04* (2006.01)
*A63H 30/00* (2006.01)

(52) U.S. Cl. ..... 446/454; 446/485; 446/456; 446/465

(58) Field of Classification Search ..... 446/454, 446/456, 457, 175, 485, 438, 437, 466, 470, 446/431, 460, 462
See application file for complete search history.

(56) References Cited

U.S. PATENT DOCUMENTS 1,443,374 A 1/1923 Mitchell
2,256,379 A 9/1941 Chaffin
2,434,693 A 1/1948 Patrik et al.
3,182,421 A * 5/1965 Glass et al. ..... 446/464
3,677,572 A 7/1972 Fontan et al.
3,859,752 A * 1/1975 Morrison et al. ..... 446/6
4,457,099 A * 7/1984 Kozuka et al. ..... 446/437

(Continued)

FOREIGN PATENT DOCUMENTS

WO WO 9518660 A1 * 7/1995

(Continued)

OTHER PUBLICATIONS

D.J. Malewicki, "ROBOSAURAUS™LIVES! / Creating a Monster", website http://www.canosoarus.com/02Robosaurus/Robobk01.htm, (et seq.), ® 1992, 16 pages (36 sheets).

(Continued)

*Primary Examiner*—Eugene Kim
*Assistant Examiner*—Urszula M Cegielnik
(74) *Attorney, Agent, or Firm*—Akin Gump Strauss Hauer & Feld LLP

(57) ABSTRACT

A toy vehicle including at least an on-board power supply, a plurality of wheels supporting the vehicle for itinerant movement, at least one motor operably coupled to at least one of the wheels to provide at least part of an itinerant movement, at least one light and a controller circuit configured to selectively supply power from the power supply to the motor(s) in response to commands from a transmitter remote from the toy vehicle and to selectively supply power to the at least one light in response to a signal indicating the vehicle is performing a particular maneuver, for example, either a special stunt or a transformation or both.

8 Claims, 5 Drawing Sheets

U.S. PATENT DOCUMENTS 4,530,670 A 7/1985 Ohno
4,559,022 A * 12/1985 Herstein et al. ..... 446/438
4,599,078 A 7/1986 Obara
4,601,519 A 7/1986 D'Andrade
4,613,927 A 9/1986 Brandt
4,643,696 A 2/1987 Law
4,648,853 A 3/1987 Siegfried
4,674,585 A 6/1987 Barlow et al.
4,712,184 A * 12/1987 Haugerud ..... 701/1
4,717,367 A 1/1988 Stubenfoll et al.
4,718,875 A * 1/1988 McKittrick et al. ..... 446/469
4,813,906 A 3/1989 Matsuyama et al.
4,822,316 A * 4/1989 Shaffer et al. ..... 446/466
5,052,680 A 10/1991 Malewicki et al.
5,129,851 A 7/1992 Villanueva
5,319,531 A * 6/1994 Kutnyak ..... 446/47
5,352,147 A 10/1994 Nagel et al.
5,392,200 A * 2/1995 Milde ..... 362/464
5,482,493 A * 1/1996 Rapisarda ..... 446/438
5,487,692 A 1/1996 Mowrer et al.
5,580,296 A 12/1996 Chow
5,643,041 A 7/1997 Mukaida
5,727,985 A 3/1998 George et al.
5,766,056 A 6/1998 Tsai
5,846,117 A * 12/1998 McGaffigan ..... 446/438
5,862,703 A * 1/1999 Tsai ..... 446/465
5,868,600 A * 2/1999 Watanabe ..... 446/460
5,902,166 A * 5/1999 Robb ..... 446/47
5,919,075 A 7/1999 George et al.
5,924,910 A 7/1999 Liu
6,033,285 A 3/2000 Fine et al.
6,095,890 A 8/2000 George et al.
6,171,171 B1 1/2001 Barthold
6,280,280 B1 8/2001 Vicino et al.
6,390,883 B1 * 5/2002 Choi ..... 446/436
6,443,466 B2 9/2002 Trubiano
6,482,064 B1 * 11/2002 Lund ..... 446/175
6,547,623 B1 * 4/2003 Collado ..... 446/47
6,589,098 B2 7/2003 Lee et al.
6,926,581 B2 8/2005 Lynders et al.
2001/0051488 A1 * 12/2001 Tachau et al. ..... 446/397

FOREIGN PATENT DOCUMENTS

WO WO 00/07681 A1 2/2000

OTHER PUBLICATIONS

Search Report for British Patent Office for Application GB0403532.5 dated Aug. 20, 2004, 3 pp.

* cited by examiner

REMOTELY CONTROLLED TOY VEHICLES WITH LIGHT(S)

CROSS-REFERENCE TO RELATED APPLICATIONS

This application claims benefit of U.S. Provisional Patent Application No. 60/423,182, "Improved Remotely Controlled Toy Vehicles With Light(s)", filed Nov. 1, 2002.

BACKGROUND OF THE INVENTION

The present invention relates generally to toy vehicles and, more particularly, to remotely controlled toy vehicles configured to transform and/or perform unusual stunts.

Remotely controlled toy vehicles are well known. One subset of these vehicles are configured to faithfully replicate known or otherwise conventional vehicles to allow users to pretend they are driving real vehicles. Another subset of such vehicles are more fanciful and designed for unusual performance capability, typically being capable of performing maneuvers that could or would not be performed by or with real vehicles. Some such vehicles are provided with lights to enhance the amusement value of such toys. Purchasers are attracted to and manufactures try to provide remotely controlled toy vehicles having new features and/or capabilities not previously provided in such vehicles for enhanced play value in such vehicles.

BRIEF SUMMARY OF THE INVENTION

A remotely controlled toy vehicle including at least an on-board power supply, at least a plurality of wheels supporting the vehicle for itinerant movement, at least one motor operably coupled to at least one of the wheels to provide at least part of the itinerant movement of the vehicle, a controller circuit configured to selectively supply power from the power supply to the at least one motor in response to commands from a transmitter remote from the vehicle to move the toy vehicle and at least one light source, characterized by the controller circuit being configured to selectively supply power to illuminate the at least one light in response to a signal indicating the vehicle is performing a particular maneuver.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
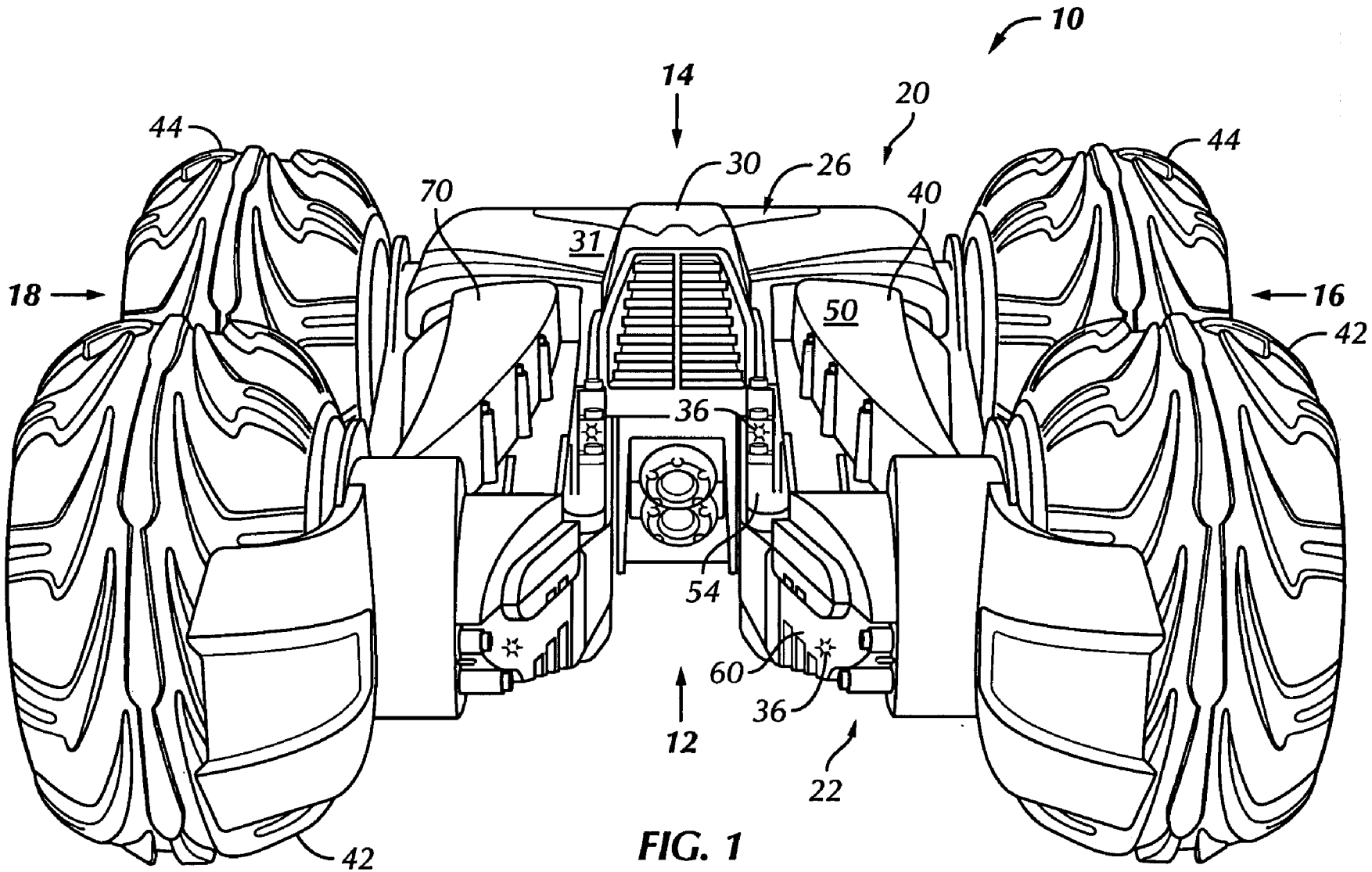
FIG. 1 is a perspective view of a first longitudinal end of a toy vehicle incorporating the present invention.

Certain terminology is used in the following description for convenience only and is not limiting. The words "right", "left", "top", "bottom", and the like designate directions in the drawings to which reference is made. The words "inner", "outer", "interior" and "exterior" refer to directions towards and away from, respectively, the geometric center of the toy vehicle or designated parts thereof. The terminology includes the words above specifically mentioned, derivatives thereof and words of similar meaning.

Referring now to the figures, there is shown a preferred embodiment of a toy vehicle indicated generally at 10, in accordance with the present invention. The vehicle 10 has a first longitudinal end 12 in the foreground in FIG. 1, a second, opposing longitudinal end 14, a first lateral side 16 and a second, opposing lateral side 18. Vehicle 10 further has a first major planar side 20 and a second, opposing major planar side 22. The vehicle 10 has a hinged chassis indicated generally at 26 that includes a central chassis portion 30 with first cover 31 and first and second lateral chassis portions 40 and 70, respectively. The first lateral chassis portion 40 is pivotally coupled with the central chassis portion 30 on the first lateral side 16 of the vehicle 10. The second lateral chassis portion 70 is a mirror image of the first lateral chassis portion 40 and is pivotally coupled with the central chassis portion 30 on the second lateral side 18 of the vehicle 10. A plurality, in particular, two road wheels 42 and 44 are rotatably supported from the first chassis portion 40. Another plurality of identical wheels 42, 44 is rotatably supported from the second chassis portion 70. The first and second lateral chassis portions 40, 70 are coupled with the central chassis portion so as to pivot with respect to the central chassis portion 30 in a common plane, which is generally parallel to the plane of FIG. 3.

Since the first and second chassis portions 40 and 70 are mirror images, only the first chassis portion 40 will be described in further detail. The first lateral chassis portion 40 includes a reversible electric motor 46 enclosed within a first cover 50 on the first chassis portion 40. The motor 46 is drivingly coupled with at least one and preferably with each of the road wheels 42, 44 supported on the lateral chassis portion to rotate the driven wheels in the same direction through a gear train (not seen in any of the figures) within the chassis portion 40. The gear train is substantially identical to that shown in U.S. Pat. No. 6,598,098, incorporated by reference herein, with a central driven gear driven directly by the motor pinion, a pair of spur gears driven by the central drive gear and a pair of wheel gears driven by the spur gears, each wheel gear including a splined drive shaft non-rotatably received in one of the wheels 42, 44.

Figure 3:
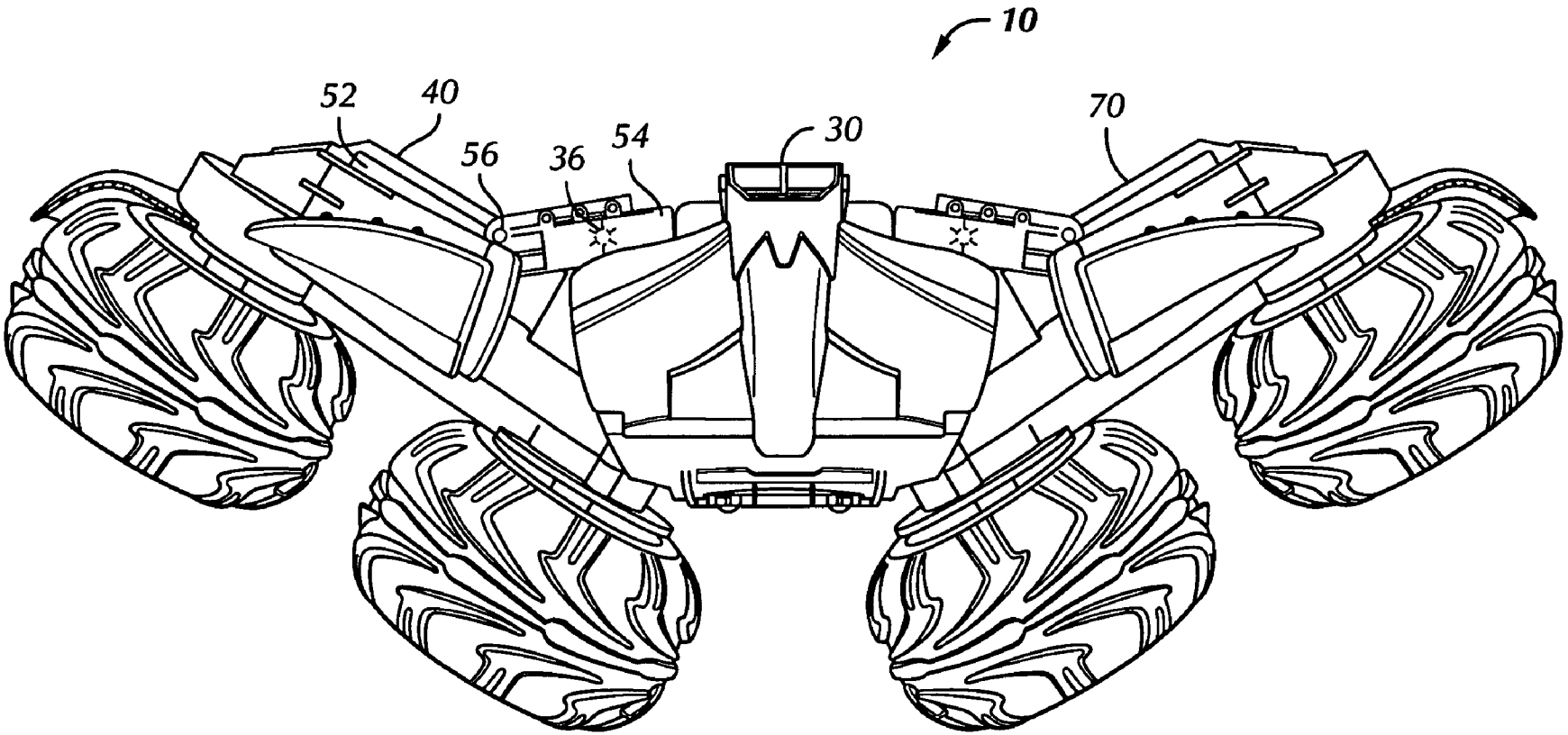
FIG. 3 is a side elevational view of the toy vehicle of FIG. 1 in a particular stunt performing configuration.

The first longitudinal end 12 of the first lateral chassis portion 40 is coupled with the first longitudinal end 12 of the central chassis portion 30 through a link 54 (best seen in FIG. 3). Link 54 has a proximal end pivotally coupled to the central chassis portion 30 to pivot about a pivot axis transverse to the major planes of the vehicle. The distal end of the link 54 is also provided with a transverse guide member in the form of a protruding pin or pin equivalent 56, which is received in and slides along a longitudinally extending slot 52 on an inner lateral side of the first lateral chassis portion 40.

Figure 2A:
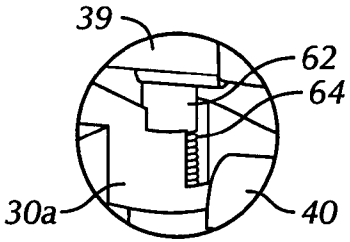
FIG. 2A is a detail view showing a torsional spring biasing the lateral chassis portion against the central chassis portion.
Figure 2:
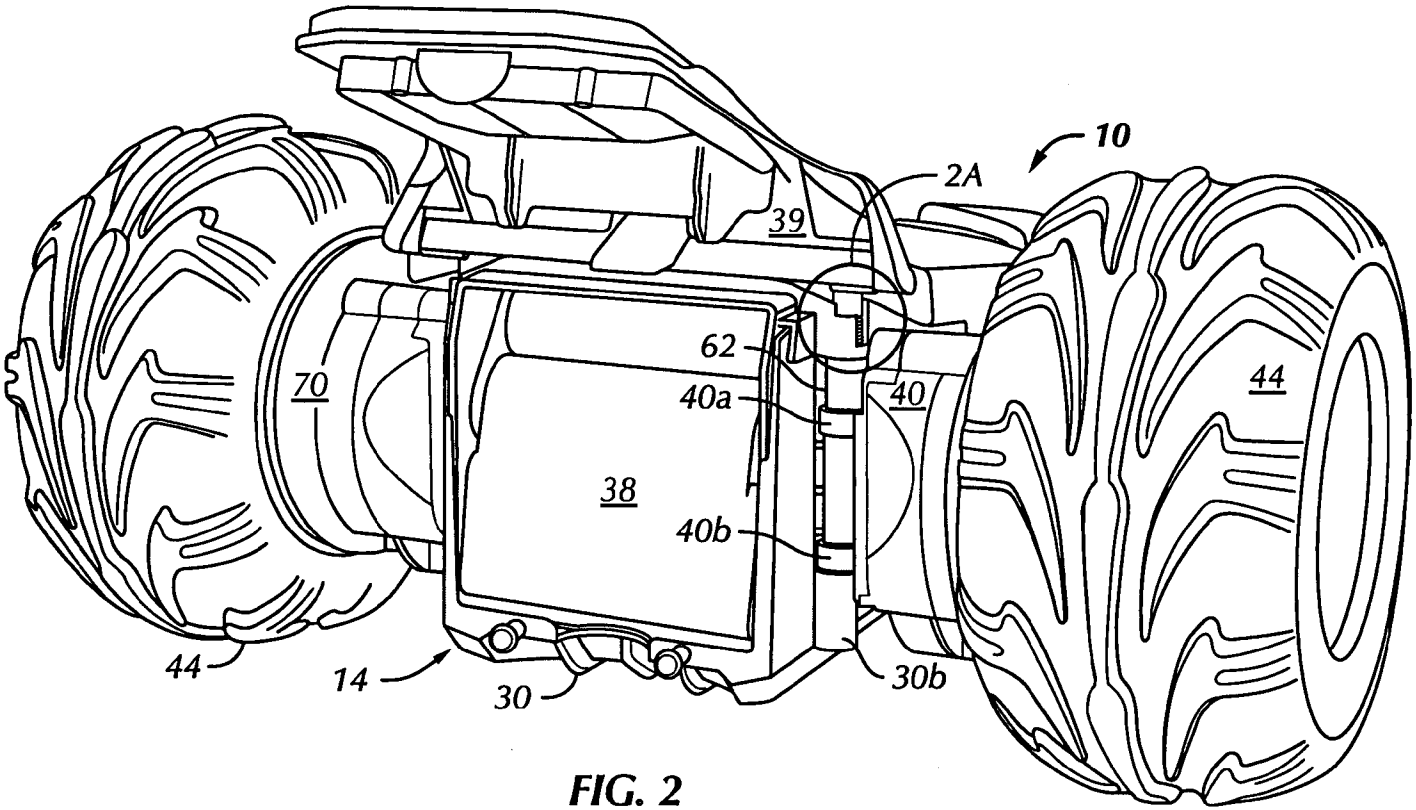
FIG. 2 is a perspective view of a second longitudinal end of the toy vehicle of FIG. 1, showing a pivotal mount of a lateral chassis portion to a central chassis portion.

FIG. 2 depicts the direct pivotal mounting of the first lateral chassis portion 40 with the central chassis portion 30 at the second longitudinal end 14 of the vehicle. The mounting of the second lateral portion 70 is a mirror image. A pivot member (e.g. pin) 62 is transverse to the major plane of the vehicle 10 and extends through overlapping flanges 30*a*, 30*b* of the central chassis portion 30 and 40*a*, 40*b* of the first lateral chassis portion 40. As indicated in detail FIG. 2A, a torsional coil spring 64 is positioned around pivot member 62. A first tang (not illustrated) of the spring 64 is engaged with a flange of the first lateral chassis portion 40. A second, opposing tang (not illustrated), is similarly engaged with a flange element of the central chassis portion 30. The torsional coil spring 64 is located to bias the first lateral chassis portion 40 inward towards the central chassis portion 30 and the inward position shown in FIG. 1. The bias of the spring 64, however, can be overcome during operation of the vehicle 10 to cause one or both lateral chassis portions 40, 70, to pivot outwardly from the central chassis portion 30, as is illustrated in FIG. 3.

A power supply 38, preferably a rechargeable battery pack, is preferably located at the extreme second longitudinal end 14 of the vehicle 10 on the end of the central chassis portion 30 to shift the center of gravity of the vehicle 10 closer towards the second longitudinal end 14 of the vehicle to assist the vehicle 10 in performing certain types of stunts, particularly the stunt shown in FIG. 3. In the embodiment illustrated, the battery power supply 38 is accessible via a battery box door 39 pivotably mounted to the chassis 30.

Referring to FIGS. 1 and 3, each lateral chassis portion 40, 70 is provided with a transparent cover 60 at the first longitudinal end of the chassis portion 40, 70 over a light source, preferably a high intensity light emitting diode ("LED") 36 (see FIG. 1). Preferably too, each link 54 is formed from a transparent polymer material and also includes a high intensity LED 36 as seen in FIG. 3 at its proximal end where it is pivotally coupled by link 54 with the central chassis portion 30.

Figure 4:
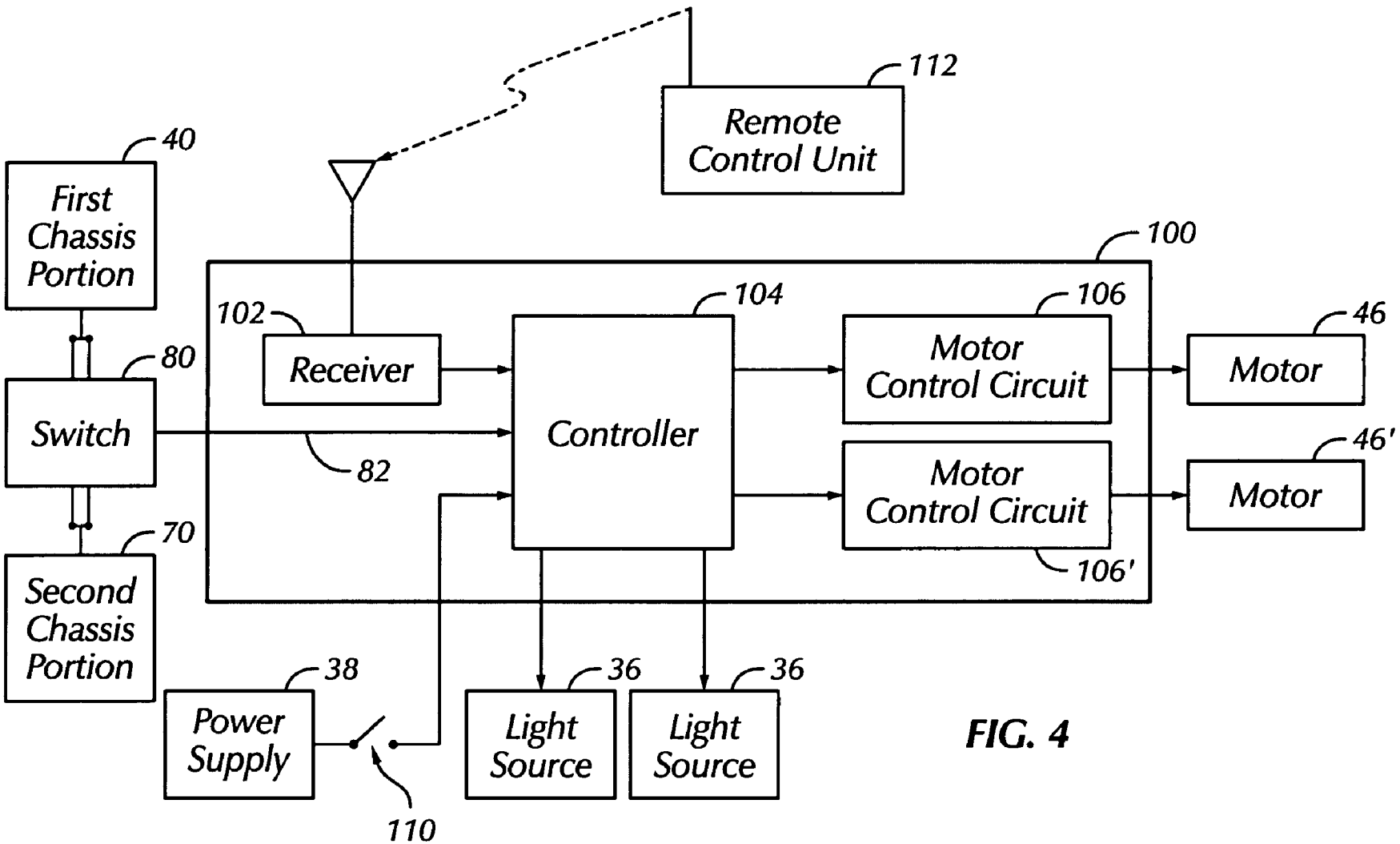
FIG. 4 is a block diagram of the electrical components of the toy vehicle of FIGS. 1—3.

Control of itinerant movement of the vehicle 10 is conventional. The vehicle includes circuitry 100 indicated in block diagram form in FIG. 4, preferably located in the central chassis portion 30, which and including a wireless, preferably radio frequency (RF) receiver 102, preprogrammed microprocessor or microcontroller 104 operably coupled with receiver 102 and with first and second propulsion/steering motor control circuits 106, 106', preferably identical, each driving a separate one of the preferably identical motors 46, 46'. The operation of the motors 46, 46' are controlled by the microprocessor 104 in response to control signals received by the receiver 102 from a remote control unit 112 generating and transmitting wireless maneuver control signals. The vehicle 10 is propelled by controlling each motor 46, 46' to rotate the various road wheels 42, 44 in the same direction at the same speed and is steered by controlling the motors to drive the wheels on either lateral side 16, 18 of either lateral chassis portion 40, 70 differently, either in different directions or at different speeds or both. By rotating the wheels 42, 44 on opposite lateral sides 16, 18 in opposite directions, the vehicle 10 can be made to spin in place. Centrifugal force causes the free longitudinal end of each lateral chassis portion 40, 70 at the first longitudinal end 12 of the vehicle 10 to spread apart. The spreading apart of the lateral chassis portions 40, 70 causes a further shift of the center of gravity of the vehicle 10 towards the second longitudinal end 14 so that, if the vehicle 10 continues to be spun in place, it will raise its first longitudinal end 12 and spin about its second longitudinal end 14 in an upright manner as seen in FIG. 3. As can be seen in FIG. 3, vehicle 10 tends to be supported on the corners and sidewalls of its road wheels 44 at the second end 14 of the vehicle 10 during such maneuvers.

While the light sources 36 conventionally might be hard wired with the battery power supply 38 to be constantly on when on-off-switch 110 is set to the ON position, closing the circuitry through the battery 38, according to the present invention, the light sources 36 preferably are individually coupled into circuit using a switch (e.g., a transistor not separately depicted) controlled by the microprocessor 104. In this way illumination of each light source 36 can be individually and selectively controlled with the microprocessor 104. Further according to the invention, the control circuitry 100 can be configured to operate the light sources 36 in more than one mode of operation. Preferably, circuitry 100 is configured to operate the light sources 36 in at least two different modes of operation. More particularly, the microprocessor 104 is configured to operate the light sources 36 in at least two different modes of operation.

This can be done in a number of ways. As explained above, vehicle 10 performs a particular stunt in which it stands up on its second end 14 and spins in place with its lateral chassis portions 40, 70 pivoted away from the central chassis portion 30. Preferably, vehicle 10 is provided with a momentary closure switch 80 (FIG. 4) positioned to change states when at least one of the lateral chassis portions 40, 70 is pivoted away from the central chassis portion 30. The microprocessor 104 is preferably configured to operate LED's 36 in two different modes depending upon the state of switch 80, as communicated to the microprocessor 104 by a signal generated by the switch 80 and sent to the microprocessor 104 along line 82. Unless the lateral chassis portion 40 or 70 is pivoted away from the central chassis portion 30, switch 80 is in a first state and the microprocessor 104 responds to that state in a first mode of operation of the LED's 36, for example illuminating some (e.g. the lateral chassis mounted pair) or all of the LED's continuously. When the switch 80 is in another state indicating that at least one of the operably coupled lateral chassis portions 40, 70 is pivoted away from the central chassis portion 30, the microprocessor 104 operates in another mode, for example flashing some (e.g., either the link pair or the lateral chassis pair) or all of the LED's 36.

Figure 5:
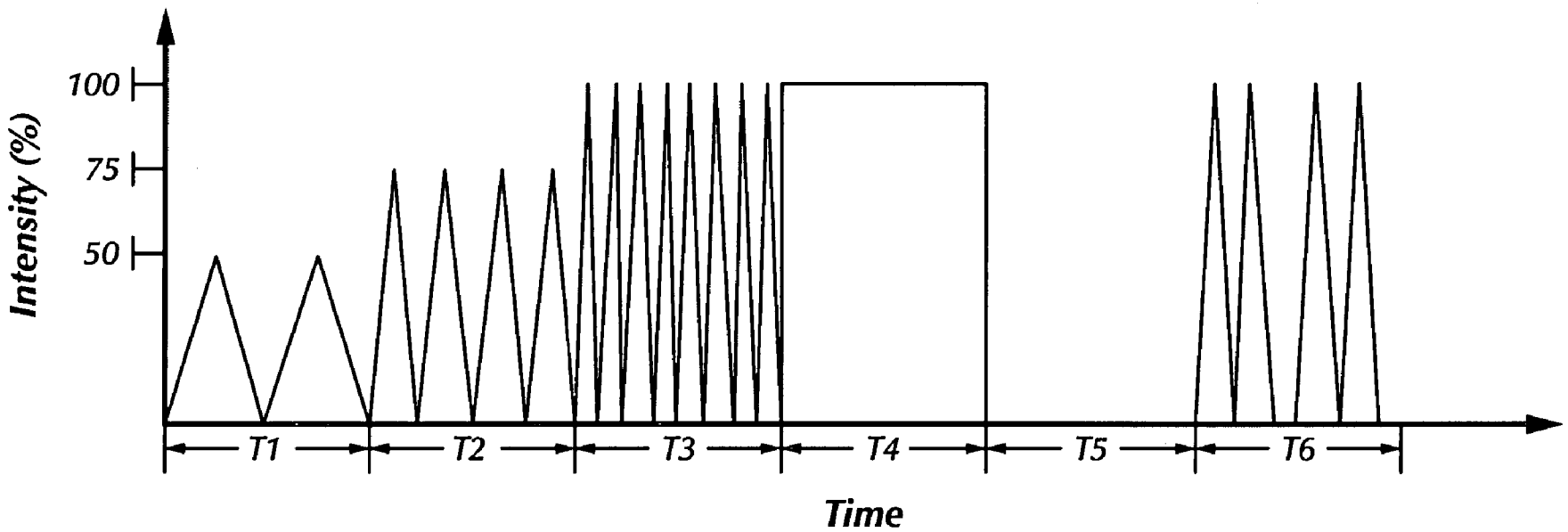
FIG. 5 is a graph showing an exemplary variable illumination cycle for the light sources of the toy vehicle of FIGS. 1–3.

FIG. 5 graphically depicts a suggested sequence of operating the light sources 36, which includes flashing all of the LED's 36 in a varying manner over time. FIG. 5 is a chart of LED illumination intensity over time. Preferably, the variation in operation, i.e., the illumination intensity of the LED, changes in consecutive time period blocks indicated T1, T2, etc. While they are illustrated as being equal, they need not be. In the first block, T1 (e.g. about five seconds), the LED's 36 are varied from zero to fifty percent of maximum intensity and back to zero twice at a uniform rate over the period (i.e., as depicted over five seconds) or, if desired, over a substantial portion (e.g. about four seconds) of the period. If switch 80 remains in the second state after the end of the first period T1, the microprocessor 104 enters the second time period T2 and second mode of illumination during which the LED's 36 are varied from zero to seventy-five percent of maximum intensity and back four times at a constant rate over the period T2. If the switch 80 remains in the second state after period T2 (i.e. more than 10 seconds), the third period T3 and third mode are entered in which the intensity is varied from zero to a maximum eight times at a uniform rate. If the fourth consecutive time period T4 is entered, the LED's 36 are illuminated constantly at full intensity for the full period. If the fifth period T5 is entered, the LED's are turned off for the length of the period. Thus, T4 and T5 together constitute one on-off cycle. If a sixth period, T6, is entered, the LED's 36 are operated intermittently with a full off period between pairs of consecutive spikes of one-hundred percent illumination as depicted or between individual spikes of illumination (not separately shown) to create a strobe effect. As consecutive time periods continue to be entered, other modes of illumination can be created. Alternatively, previous practiced modes can be repeated or the last mode repeated indefinitely. Other possible modes include varying intensity levels down to a non-zero level and illuminating the light sources in series or in various pairs or randomly. The microprocessor 104 might utilize a stored look-up table to control the different illumination modes.

It will be appreciated by those skilled in the art that changes could be made to the embodiments described above without departing from the broad inventive concept thereof. For example, instead of responding to a sensed state of the vehicle, the microprocessor can be programmed to respond to different commanded operations, for example illuminating in a first mode when commanded to go forward, in another mode when commanded to reverse, in still another mode for turning, yet another mode when stopped and yet another mode when spinning in place. If the vehicle is capable of transforming itself as described, for example, in U.S. Pat. Nos. 5,762,533; 5,474,486 and 5,332,469 or is capable of performing unusual stunts as described, for example, in U.S. Pat. Nos. 5,429,543; 5,667,420; 5,882,241 or 6,024,627, the mode of illumination can change in response to commands to perform the transformation or perform the stunt. It is understood, therefore, that this invention is not limited to the particular embodiments disclosed, but it is intended to cover modifications within the spirit and scope of the present invention as defined by the appended claims.

We claim:

1. A remotely controlled toy vehicle comprising:

at least an on-board power supply, at least a plurality of wheels supporting the vehicle for itinerant movement, at least one motor operably coupled to at least one of the wheels to provide at least part of the itinerant movement of the vehicle, a controller circuit configured to selectively supply power from the power supply to the at least one motor in response to commands from a transmitter remote from the vehicle to move the toy vehicle, at least one light source, the controller circuit being configured to selectively supply power to illuminate the at least one light source in response to a signal indicating the vehicle is performing a particular maneuver, a hinged, three part chassis having a first longitudinal end and a second, opposing longitudinal end and including a central chassis portion having opposing first and second lateral sides, a first lateral chassis portion pivotally coupled with the central chassis portion on the first lateral side of the central chassis portion, and a second lateral chassis portion pivotally coupled to the central chassis portion on a second lateral side of the central chassis portion, wherein the first and second lateral chassis portions are coupled so as to pivot with respect to the central chassis portion in a common plane, and wherein the signal is generated by a switch adapted to detect a position of at least one of the lateral chassis portions relative to the central chassis portion.

2. The remotely controlled toy vehicle of claim 1 further comprising:

a pair of links, each link being pivotally coupled to the central chassis portion and to a separate one of the first and second lateral chassis portions at the first longitudinal end of the vehicle so as to permit the first longitudinal end of each lateral chassis portion to pivot away from and towards the central chassis portion, and a separate light source in each link.

3. The remotely controlled toy vehicle of claim 1 wherein at least a first one of the plurality of wheels is operably attached to the first lateral chassis portion, and at least a second one of the plurality of wheels is operably attached to the second lateral chassis portion.

4. The remotely controlled toy vehicle of claim 1 wherein at least a first pair of the plurality of wheels are operably attached to the first lateral chassis portion, one proximal the first longitudinal end and a remaining one proximal the second longitudinal end.

5. A remotely controlled toy vehicle comprising:

at least an on-board power supply, at least a plurality of wheels supporting the vehicle for itinerant movement, at least one motor operably coupled to at least one of the wheels to provide at least part of the itinerant movement of the vehicle, a controller circuit configured to selectively supply power from the power supply to the at least one motor in response to commands from a transmitter remote from the vehicle to move the toy vehicle, at least one light source, the controller circuit being configured to selectively supply power to illuminate the at least one light source in response to a signal indicating the vehicle is performing a particular maneuver, a hinged, three part chassis having a first longitudinal end and a second, opposing longitudinal end and including a central chassis portion having opposing first and second lateral sides, a first lateral chassis portion pivotally coupled with the central chassis portion on the first lateral side of the central chassis portion, and a second lateral chassis portion pivotally coupled to the central chassis portion on a second lateral side of the central chassis portion, wherein the first and second lateral chassis portions are coupled so as to pivot with respect to the central chassis portion in a common plane, and wherein the signal is generated by a switch operably coupled with each of the first and second lateral chassis portions.

6. The remotely controlled toy vehicle of claim 5 further comprising:

a pair of links, each link being pivotally coupled to the central chassis portion and to a separate one of the first and second lateral chassis portions at the first longitudinal end of the vehicle so as to permit the first longitudinal end of each lateral chassis portion to pivot away from and towards the central chassis portion, and a separate light source in each link.

7. The remotely controlled toy vehicle of claim 5 wherein at least a first one of the plurality of wheels is being operably attached to the first lateral chassis portion, and at least a second one of the plurality of wheels is operably attached to the second lateral chassis portion.

8. The remotely controlled toy vehicle of claim 5 wherein at least a first pair of the plurality of wheels are operably attached to the first lateral chassis portion, one proximal the first longitudinal end and a remaining one proximal the second longitudinal end.

* * * * *